US005108872A

United States Patent [19]

Inoue et al.

[11] Patent Number: 5,108,872

[45] Date of Patent: Apr. 28, 1992

[54] SILVER HALIDE PHOTOGRAPHIC MATERIAL AND METHOD OF FORMING IMAGES USING SAME

[75] Inventors: Nobuaki Inoue; Morio Yagihara; Naomi Saeki, all Kanagawa, Japan

[73] Assignee: Fuji Photo Film Co., Ltd., Kanagawa, Japan

[21] Appl. No.: 614,601

[22] Filed: Nov. 15, 1990

Related U.S. Application Data

[62] Division of Ser. No. 386,075, Jul. 28, 1989, abandoned.

[30] Foreign Application Priority Data

Jul. 28, 1988 [JP] Japan ..... 63-189080

[51] Int. Cl.[5] ..... G03C 1/06

[52] U.S. Cl. ..... 430/264; 430/204; 430/267; 430/445; 430/567; 430/572; 430/584; 430/944

[58] Field of Search ..... 430/572, 584, 944, 567, 430/204, 445, 264, 267

[56] References Cited

U.S. PATENT DOCUMENTS 4,536,473 8/1985 Mihara ..... 430/584
4,596,767 6/1986 Mihara et al. ..... 430/584
4,670,377 6/1987 Miyoshi et al. ..... 430/584
4,770,961 9/1988 Tanaka et al. ..... 430/584
4,833,064 5/1989 Okutsu et al. ..... 430/267
4,873,170 10/1989 Nishinoiri et al. ..... 430/204
5,059,508 10/1991 Vaes et al. ..... 430/204

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material comprising a support having thereon at least one light-sensitive layer comprising a silver halide emulsion sensitized by an infrared sensitization dye, wherein the silver halide in the silver halide emulsion contains at least 90 mol % of silver chloride and is constituted by monodisperse grains having a coefficient of variation of not more than 20%; and an image formation method using the above-described silver halide photographic photosensitive material, comprising the steps of imagewise exposing the photographic material and developing the said material in a developing solution containing at least 0.15 mol/l of sulfurous acid ions and a compound having a silver halide-adsorption accelerating group.

11 Claims, No Drawings

SILVER HALIDE PHOTOGRAPHIC MATERIAL AND METHOD OF FORMING IMAGES USING SAME

This is a divisional of application Ser. No. 07/386,075 filed Jul. 28, 1989, now abandoned.

FIELD OF THE INVENTION

The present invention relates to a silver halide photographic material spectrally sensitized in the infrared region, and to a method of image formation using this material. Particularly, the present invention relates to a photographic light-sensitive material spectrally sensitized in the infrared region suitable for development treatment in platemaking, and to an image formation method using this material.

BACKGROUND OF THE INVENTION

One method for the exposure of a photographic light-sensitive material includes a scanner-system image formation method, wherein an original is scanned and a silver halide photographic material is exposed in accordance with the document's image signals. A negative image or a positive image corresponding to the image of the original document is thus formed.

A variety of recording apparatus use the scanner-system image formation method, and glow lamps, xenon lamps, mercury lamps, tungsten lamps and light-emitting diodes, etc. have been used as the recording light source in scanner system recording apparatus. However, all these light sources are disadvantageous in that the source output is weak and have a short operating life. Scanner systems that overcome these drawbacks include scanners which employ Ne-He laser, argon laser, He-Cd laser and similar coherent laser light sources. Although these sources have a high light output, they are disadvantageous in that the equipment is cumbersome and expensive, modulators are required, the use of safe-light is restricted since visible light is employed, and the equipment is not easy to handle.

In contrast, semiconductor lasers are advantageous in that they are compact and inexpensive, modulation is easy, and semiconductor lasers have a longer life than the above-noted lasers. Semiconductor lasers are convenient to work with since they emit light in the infrared region, and consequently, a bright safe light may be employed if a light-sensitive material is employed which is sensitive to light in the infrared region.

Light-sensitive materials that can be advantageously used with semiconductor laser sources have recently become commercially available.

The computerization and reduction of size which started with layout scanners in the printing industry, have made possible large quantities of good quality printing even in an office environment. Namely, the preparatory work for plates can be done on a CRT screen, and an electronic computer photosetting unit is used to effect the output via floppy disks onto printing paper or film. A photographic light-sensitive material that is sensitive to semiconductor laser light (680 nm) is then used.

However, this light-sensitive material is disadvantageous in that large amounts of developing solution are used. Additionally, a great deal of space is needed for a replenisher therefor. Therefore, there has been a demand for a silver halide photographic material which permits reduction of the amount of replenishers, and for a processing method thereof wherein problems such as fogged patches in unexposed portions caused by silver fouling due to silver ion dissolved in the developing solution or physical development of silver dissolved out during fixation and attached on the processed material, etc. are minimized.

JP-A-60-80841, JP-A-62-299838, JP-A-62-299839, JP-A-61-70550, JP-A-63-115159, JP-A-63-115160 and JP-A-63-115161 (the term "JP-A" as referred to herein means an "unexamined published Japanese patent publication") disclose photographic light-sensitive materials comprising silver halide grains containing silver chloride that are sensitive to semiconductor laser light (i.e., spectrally sensitized to the infrared region). JP-A-63-49752, JP-A-63-83719 and JP-A-63-89838 disclose silver bromide and silver iodobromide systems.

In addition to the dyes disclosed in the above noted disclosures, other infrared sensitization dyes have been developed, as disclosed in, e.g., U.S. Pat. Nos. 2,095,854, 2,095,856, 2,955,939, 3,458,318, 3,482,978, 3,552,974, 3,573,921, 3,582,344, 3,615,632 and 4,011,083.

Methods for improvement of silver fouling and unevenness of development during development treatment are disclosed in JP-A-56-24347, JP-A-62-212615, JP-A-57-6848, JP-A-57-116340, JP-A-60-258537 and JP-A-62-212651.

SUMMARY OF THE INVENTION

A first object of the present invention is to provide a silver halide photographic material which is sensitive to infrared light, having little variation in performance even when large quantities of film are processed, and more particularly to provide a silver halide photographic material for use with a semi-conductor laser light source.

A second object of the present invention is to provide an image forming method which minimizes the fouling of development solutions by the silver sludge thereby produced or the fouling of rollers or belts; to provide photographic images of excellent finished quality that are free of silver fouling or processing unevenness caused by physical development.

These objects of the present invention are achieved by a silver halide photographic material comprising a support having thereon at least one light-sensitive layer comprising a silver halide emulsion sensitized by an infrared sensitizing dye, wherein the silver halide in the silver halide emulsion contains at least 90 mol % of silver chloride and is constituted by monodisperse grains having a coefficient of variation of not more than 20%; and an image forming method using the above-described silver halide photographic material, comprising the steps of imagewise exposing the photographic material and developing the material in a developing solution containing at least 0.15 mol/l of sulfurous acid ions and a compound having a silver halide-adsorption accelerating group.

DETAILED DESCRIPTION OF THE INVENTION

The silver halide emulsion of the silver halide photographic material for use in the present invention comprises a silver halide having a silver chloride content of at least 90 mol% and preferably at least 95 mol %, selected from silver chlorobromide, silver chloroiodide or silver chloroiodobromide containing 0 to 10 mol % of silver bromide and 0 to 2 mol % of silver iodide.

The silver halide grains of the present invention may be in the shape of, e.g., cubes, octahedra, tetradecahedra, tabular bodies or spheroids, but cubes and tetradecahedra are preferred.

The silver halide grains of the present invention comprise a monodisperse silver halide emulsion having a coefficient of variation of the grain size distribution of not more than 20%, and particularly not more than 15%.

The coefficient of variation (hereafter also referred to as "dispersion coefficient") as used herein is defined as follows.

$$\text{Coefficient of variation (\%)} = \frac{\text{Grain diameter standard variation}}{\text{Average value of grain diameter}} \times 100$$

The grain size is preferably 0.06 μ to 0.6 μ, and 0.06 μ to 0.4 μ is particularly preferred.

The photographic emulsion for use in the invention may be prepared by the methods described in *Chimie et Physique Photographique*, by P. Glafkides (published by the Paul Montel Company, 1967), *Photographic Emulsion Chemistry*, by G.F. Duffin (published by The Focal Press, 1966) or *Making and Coating Photographic Emulsion*, by V.L. Zelikman et al (published by The Focal Press, 1964), etc.

The following may be used for preparing the photographic emulsion of the present invention.

An acidic process, neutral process or ammonia process, etc. may be used to prepare the photographic emulsion of the present invention. For the formation by reaction of a soluble silver salt and a soluble halogen salt, a single jet process, a simultaneous mixing process or a combination of these processes may be used.

A process may also be used wherein the grains are formed in an excess of silver ion (i.e., the reverse mixing process). The simultaneous mixing process includes the controlled double-jet process wherein the pAg in the liquid phase in which the silver halide is formed is kept constant.

The controlled double-jet process provides a silver halide emulsion having a regular crystal shape, and a uniform grain size.

To provide a uniform grain size, it is preferable to grow the grains rapidly within a range wherein the critical degree of saturation is not exceeded by means of a method in which the rates of addition of the silver nitrate and alkali halides are varied in accordance with the grain growth rate as described in U.K. Patent 1,535,016 and JP-B-48-36890 and JP-B-52-16364 (the term "JP-B" as used herein means an "examined published Japanese patent publication"), or a method wherein the concentration in an aqueous solution is varied as described in U.K. Patent 4,242,445 and JP-A-55-158124.

Good results are obtained if the silver chloride monodisperse emulsion of the present invention is prepared with the silver potential at 100 mV or more and preferably 150 to 400 mV, and with a sufficiently high rate of stirring to effect uniform mixing. With silver halide grains, grain growth may occur even in a water-washing stage or dispersion stage, because of the great solubility of the material. A temperature of 35° C. or less or introduction of a nucleic acid, mercapto compound or tetrazaindene compound, etc. may be employed for inhibiting grain growth.

Preferably, the silver halide emulsion of the present invention is treated with a rhodium salt or iridium salt before the completion of physical ripening, and more particularly at the time of grain growth.

Rhodium monochloride, rhodium dichloride, rhodium trichloride and ammonium hexachlororhodate, etc. are useful; rhodium salts, and water-soluble trivalent rhodium halide complex compounds, e.g., hexachlororhodium (III) acid or salts thereof (ammonium salt, sodium salt or potassium salt, etc.) are preferred.

Useful iridium salts include water-soluble iridium salts and complex iridium salts, e.g., iridium trichloride, iridium tetrachloride, potassium hexachloroiridate (III), potassium hexachloroiridate (IV) and ammonium hexachloroiridate (III), etc. A preferred range for the addition amount of each of rhodium salts and iridium salts is $1\times10^{-8}$ to $1\times10^{-6}$ mol/mol Ag.

The high silver chloride content grains for use in the present invention are preferably in the form of a silver halide emulsion as disclosed in U.S. Pat. application Ser. No. 286,795, such that there are high silver bromide content regions in the vicinity of the vertices of the cubic grains having a silver chloride content of 90 mol %.

The silver halide emulsion for us in the method of the present invention may be chemically sensitized. Sulfur sensitization, reduction sensitization and noble metal sensitization methods may be used for chemical sensitization of silver halide emulsions of the present invention, and chemical sensitization may be effected by any of the above methods, used alone or in combination.

Noble metal sensitizers for use in the present invention include a variety of metal salts, e.g., potassium chloroaurite, potassium auric thiocyanate, potassium chloroaurate and auric trichloride, etc.

Sulfur sensitizers employable in the present invention include sulfur compounds contained in gelatin and a variety of other sulfur compounds, e.9., thiosulfates, thioureas, thiazoles and rhodanines, etc. Preferred sulfur compounds are thiosulfates and thiourea compounds.

The addition amount of each of the sulfur sensitizer and metal sensitizer is preferably in the range of from $1\times10^{-2}$ to $1\times10^{-7}$ mol and more preferably from $1\times10^{-3}$ to $1\times10^{-5}$ mol per mol of silver.

The molar ratio of the sulfur sensitizer to metal sensitizer is 1:3 to 3:1 and preferably 1:2 to 2:1.

Complex salts of other noble metals, e.g., platinum, palladium and iridium, etc., may be used as metal sensitizers of the emulsion of the present invention.

A reduction sensitization method can also be used in the present invention.

Stannous salts, amines, formamidinesulfinic acid and silane compounds, etc. may be used as the reduction sensitizers.

Examples of infrared spectral sensitizing dyes for use in the present invention are tricarbocyanine dyes disclosed in JP-A-60-80841, JP-A-62-299838 and JP-A-62-299839, specific examples thereof being as follows.

I-1
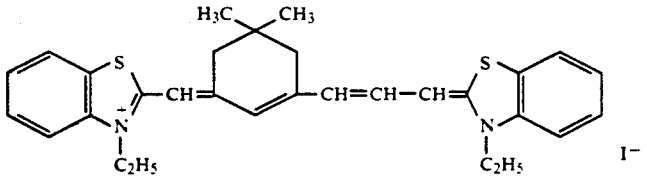
I-2
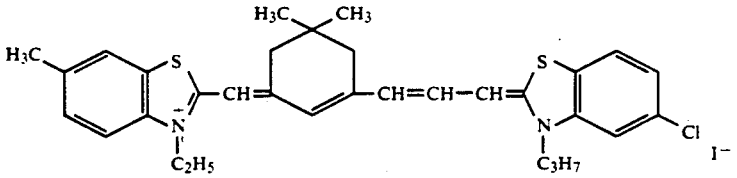
I-3
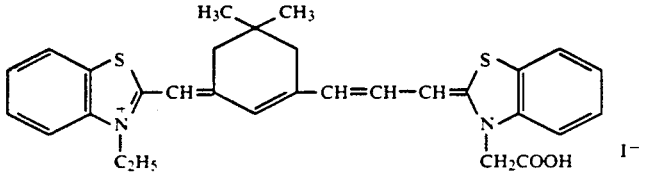
I-4
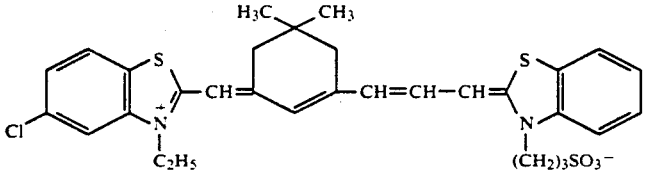
I-5
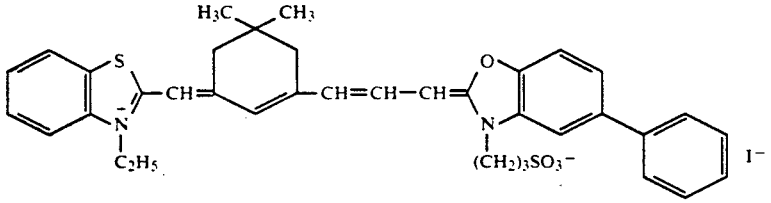
I-6
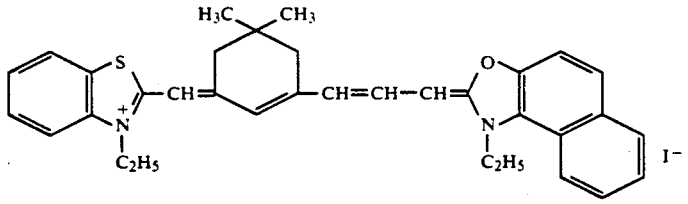
I-7
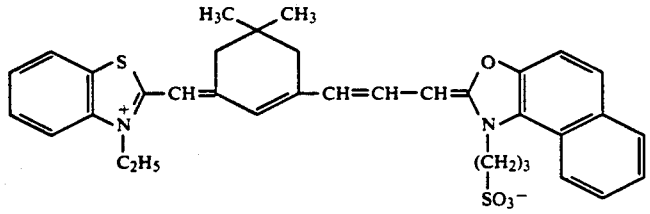
I-8
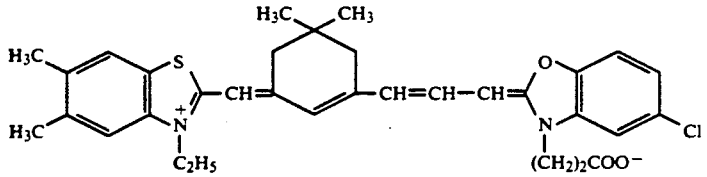

-continued
I-9
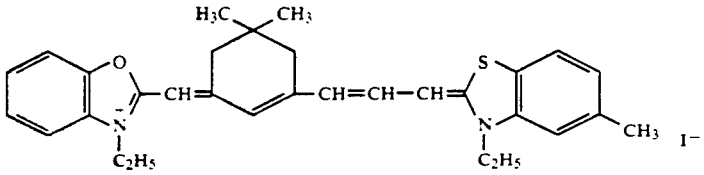
I-10
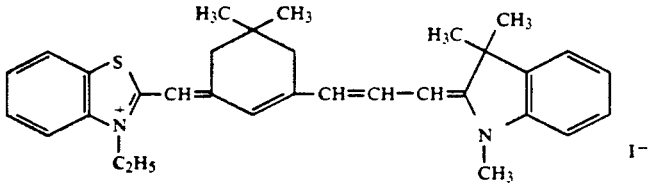
I-11
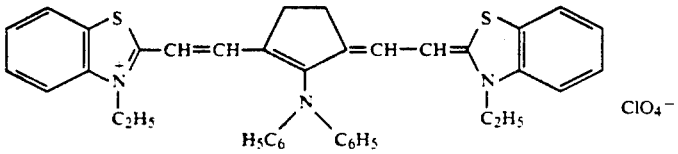
I-12
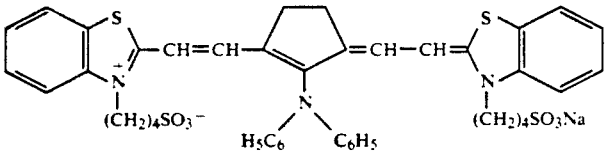
I-13
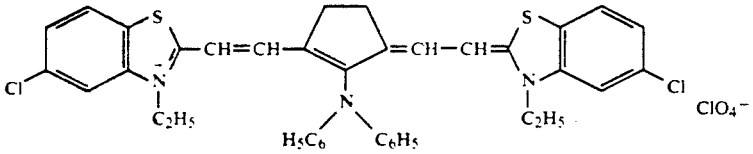
I-14
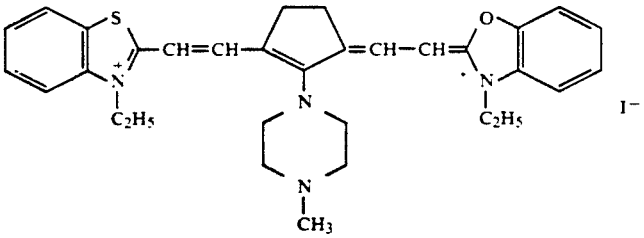
I-15
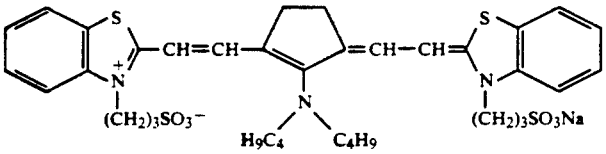
I-16
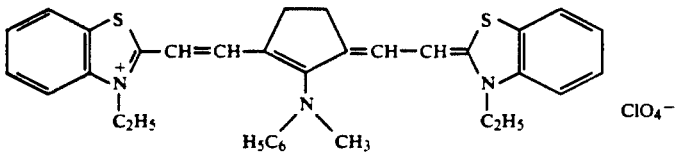

-continued
I-17
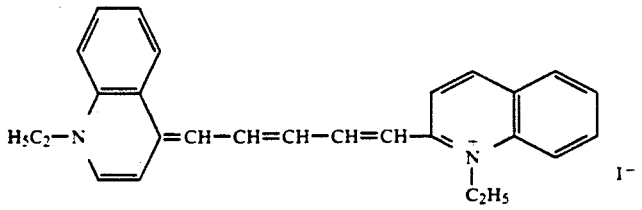
I-18
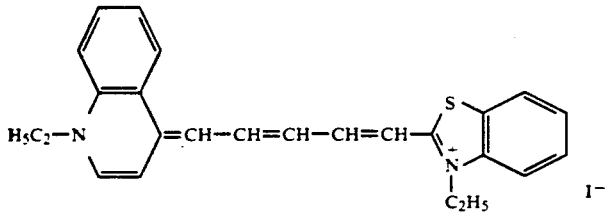
I-19
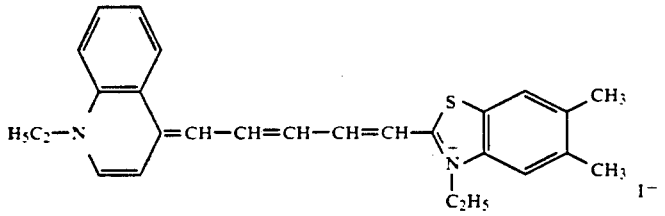
I-20
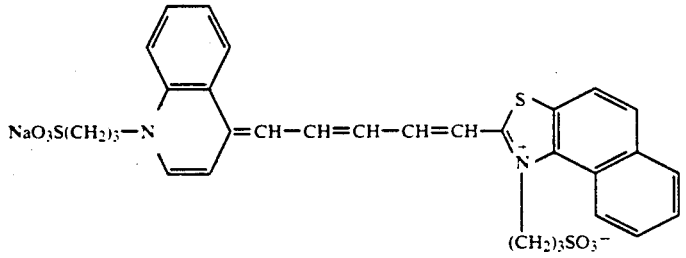
I-21
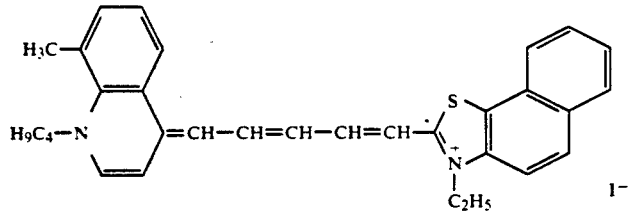
I-22
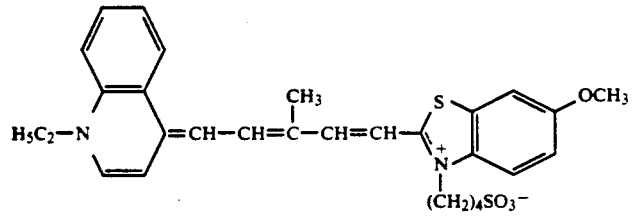
I-23
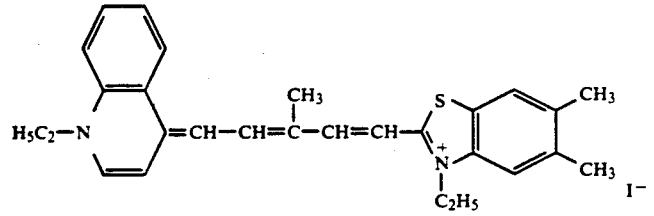

-continued

I-24

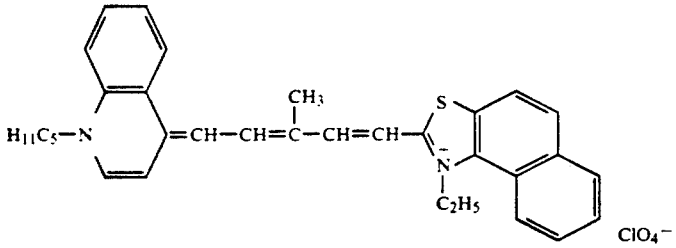

The infrared spectral sensitizing dye is incorporated in the silver halide emulsion layer generally in an amount of from $5\times10^{-7}$ to $5\times10^{-3}$ mol, preferably from $1\times10^{-6}$ to $1\times10^{-3}$ mol, and more preferably from $2\times10^{-6}$ to $5\times10^{-4}$ mol, per mol of silver halide.

The sensitizing dye may be added directly to the silver halide emulsion, or first added to a solvent, such as methyl alcohol, ethyl alcohol, methyl cellosolve, acetone, water, pyridine or a mixture thereof and then added to the silver halide emulsion in the form of solution. Ultrasonic wave may be applied for dissolution of the dye. Further, there are other methods for addition of the sensitizing dye, such as a method described in U.S. Pat. No. 3,469,987 wherein a dye is dissolved in a volatile organic solvent, which is then dispersed in a hydrophilic colloid solution, and the resulting dispersion is added to an emulsion; a method as described in JP-B-46-24185 wherein a water-insoluble dye is dispersed in a water-soluble solvent, and the resulting dispersion is added to an emulsion; a method as described in U.S. Pat. No. 3,822,135 wherein a solution of a dye in a surface active agent is added to an emulsion; a method as described in JP-A-51-74624 wherein a dye is dissolved using a compound capable of shifting the adsorption of the dye toward the red region and the resulting solution is added to an emulsion; and a method as described in JP-A-50-80826 wherein a dye is first dissolved in a substantially water-free acid and then added to an emulsion in the form of solution. Methods as described in U.S. Pat. Nos. 2,912,343, 3,342,605, 2,996,287 and 3,429,835 may also be used for the purpose. The above-described infrared spectral sensitizing dyes may be uniformly dispersed in the silver halide emulsion at any stages before coating the emulsion on a support and can be dispersed during preparation of the silver halide emulsion.

The photographic light-sensitive material of the present invention preferably contains the compounds of the general formulae (III) and (IV) disclosed in JP-A-60-80841 in order to enhance the infrared spectral sensitization effects or to improve storability, respectively. Specific examples of these compounds (hereinafter collectively referred to as "sensitization/storability improver") are as follows.

II-1

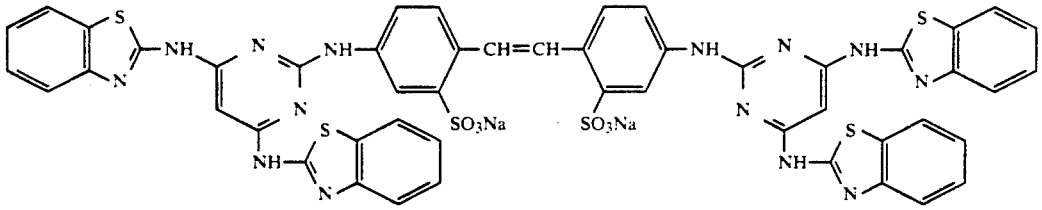

II-2

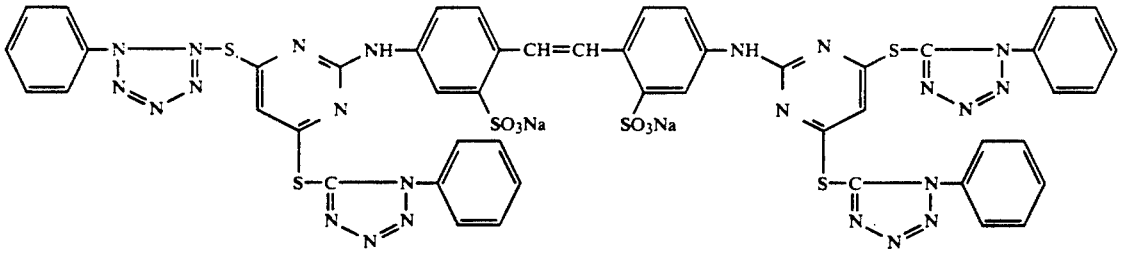

II-3

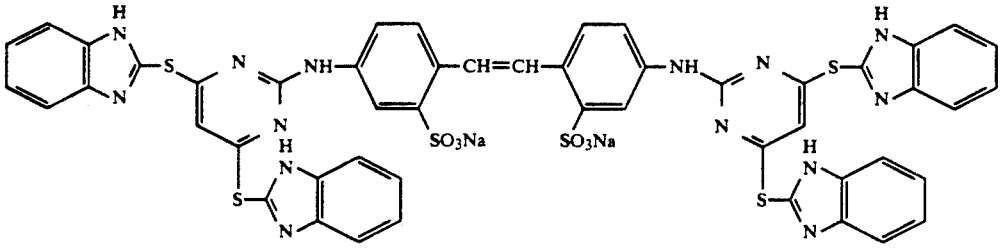

-continued

II-4

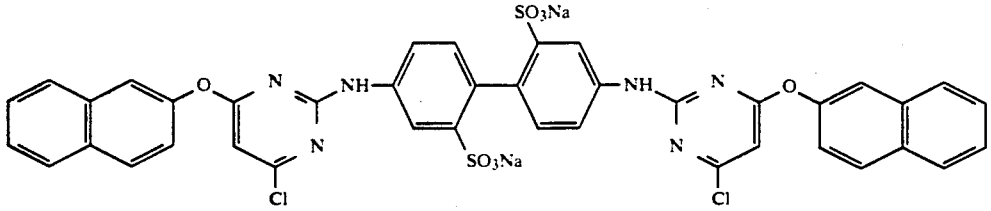

II-5

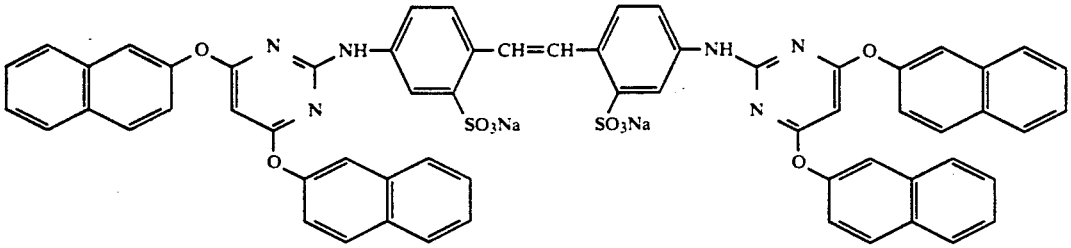

II-6

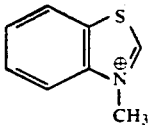

II-7

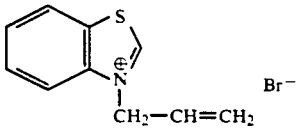

II-8

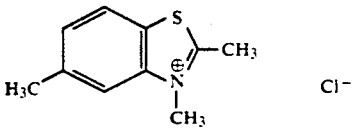

II-9

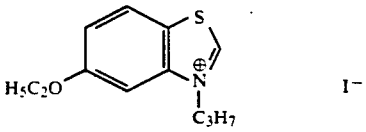

II-10

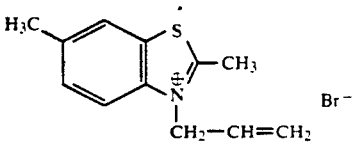

II-11

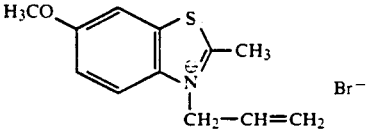

II-12

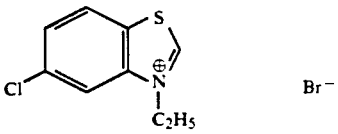

II-13

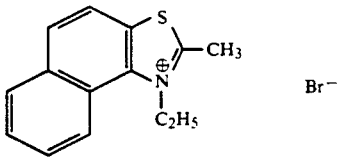

The sensitization/storability improver described above is preferably added in an amount of from 0.01 to 5 g per mol of silver halide in the emulsion.

The weight ratio of the aforesaid infrared spectral sensitizing dye to the sensitization/storability improver is preferably from 1:1 to 1:300 and more preferably from 1:2 to 1:50.

The sensitization/storability improver may be added to the silver halide emulsion directly or in the form of solution using a solvent such as water, methyl alcohol, ethyl alcohol, propanol, methyl cellosolve and acetone, or a mixed solvent thereof. Further, the improver may be added in the form of solution or dispersion in a colloidal medium in a similar manner as in the case of addition of the infrared spectral sensitizing dye as described above.

The sensitization/storability improver may be added to the emulsion either before or after addition of the sensitizing dye. The improver and the sensitizing dye may be added separately or simultaneously. They can also be added to the emulsion as admixture.

The photosensitive material of the present invention preferably contains a polyhydroxybenzene compound. The polyhydroxybenzene compound is preferably a compound represented by the following structures.

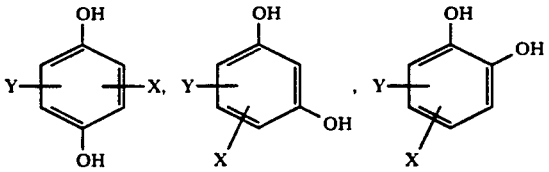

X and Y each represents a hydrogen atom, a hydroxy group, a halogen atom, —OM group (where M is an alkali metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkyl ether group, an alkylphenyl group, an alkylthioether group or a phenylthioether group.

X and Y are preferably —H, —OH, —Cl, —Br, —COOH, —$CH_2CH_2COOH$, —$CH_3$, —$CH_2CH_3$, —$CH(CH_3)_2$, —$C(CH_3)_3$, —$OCH_3$, —CHO, —$SO_3Na$, —$SO_3H$, —$SCH_3$,

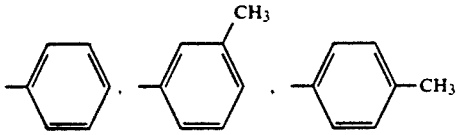

etc. X and Y may be the same or different.

Nonlimiting examples of particularly preferred polyhydroxybenzene compounds are as follows.

III-1

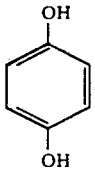

III-2

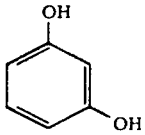

III-3

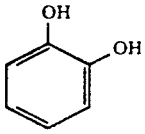

III-4

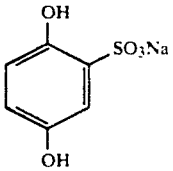

III-5

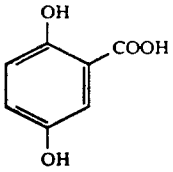

III-6

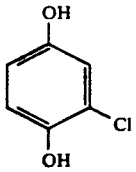

III-7

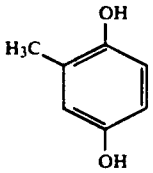

-continued

III-8

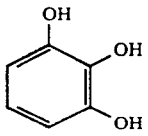

III-9

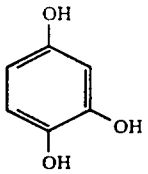

III-10

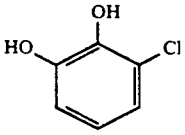

III-11

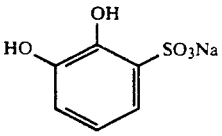

III-12

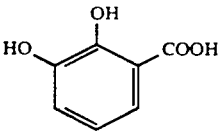

III-13

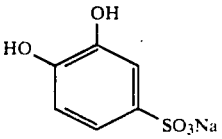

III-14

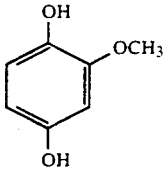

III-15

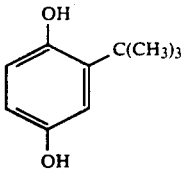

The polyhydroxybenzene compound for use in the present invention may be added to the emulsion layer or to a layer other than the emulsion layer. An addition amount of the compound is preferably from $1\times10^{-5}$ to 1 mol, more preferably from $1\times10^{-3}$ to $1\times10^{-1}$ mol, per 1 mol of silver.

In particular, hydroquinone derivatives are extremely useful in silver chloride emulsions for improving the processing characteristics by use thereof as an internal developing agent and are also useful with respect to improving pressure resistance and the prevention of thermal fog, etc.

The photographic light-sensitive material of the invention preferably contains an anti-halation dye or an anti-irradiation dye in order to improve image quality.

Preferred dyes (hereafter referred to as "photographic dye") are represented by the general formulae (Va) to (Vd) disclosed in JP-A-60-80841. Preferred representative examples are as follows.
IV-1
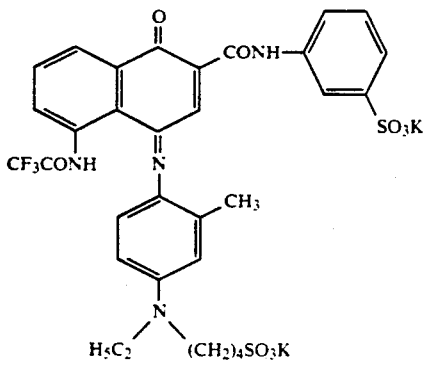
IV-2
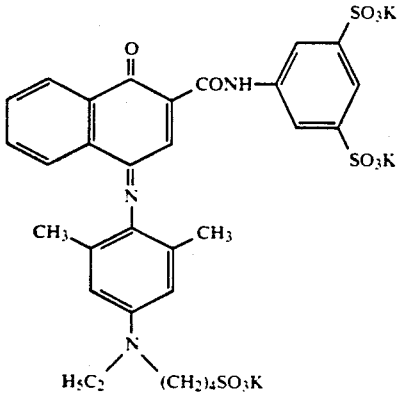
IV-3
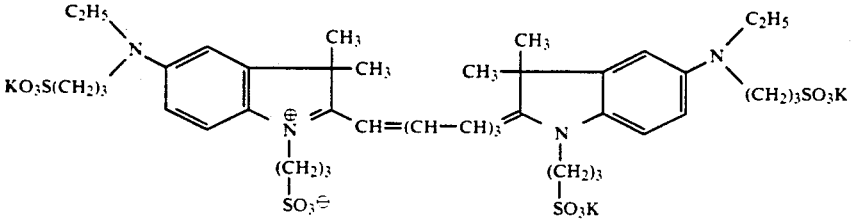
IV-4
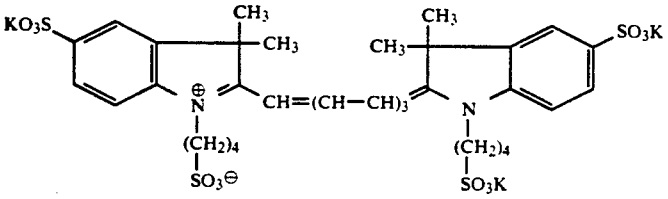
IV-5
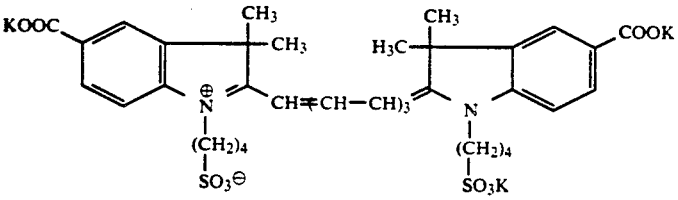

-continued

IV-6

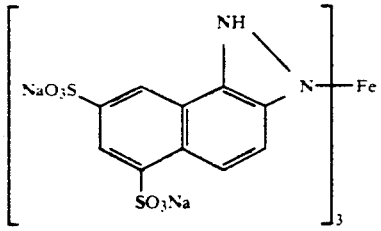

In addition to the above-noted compounds, the compounds disclosed in JP-A-62-3250, JP-A-6174540 and JP-A-62-123454 and Japanese Patent Application No. 60-174940 are useful dyes represented by the above-noted general formulae (Va) to (Vd). These dyes may be used alone or in combination thereof.

These photographic dyes are generally incorporated in the emulsion layer for prevention of irradiation, and they are generally incorporated in a backing layer of the support or a layer between the support or the emulsion layer for the purpose of prevention of halation. These dyes may also be used to improve workability under safelight. In the case the dyes are generally added in a layer positioned over the emulsion layer (e.g., a protective layer) with or without other dyes capable of absorbing a light other than safelight. The photographic dyes may also be used as filter dyes.

As described above, the photographic dyes may be added to any hydrophilic colloid layer constituting a silver halide photographic material, such as a protective layer, a silver halide emulsion layer, an anti-halation layer, a backing layer, and the like.

The photographic dyes may be incorporated to the above-described layer(s) in a conventional manner, for example, by preparing a solution having a proper concentration of the dye, adding the solution to an aqueous solution of hydrophilic colloid for the intended layer, and then coating it on the support or other layers.

The amount of the photographic dye varies depending on the purpose of addition and the type of dyes, but it is preferably from $1\times10^{-3}$ to 1 g/m$^2$, and more preferably from $1\times10^{-3}$ to 0.5 g/m$^2$. When the dye is incorporated in a backing layer, the dye is generally used in such an amount as to provide a transmission optical density at 740 to 840 nm of 0.6 or more.

A variety of compounds may be included in the photosensitive material of the present invention for the purpose of preventing fogging during the manufacture, storage and photographic processing thereof, and for stabilizing photographic properties. Particularly, antifogging agents or stabilizers may be added such as azoles, e.g., benzothiazolinium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles, etc.; mercaptopyrimidines; mercaptotriazines; thioketo compounds such as oxazolinethione, e.g., azaindenes, e.g., triazaindenes; tetraazaindenes (especially 4-hydroxy substituted (1,3,3a,7)tetraazaindenes) and pentaazaindenes, etc.; benzenethiosulfonic acid, benzenesulfinic acid and benzenesulfonic acid amides, etc.

Water-soluble dyes may be included in the photosensitive material of the present invention as filter dyes in hydrophilic colloid layers thereof or for the prevention of irradiation or a variety of other purposes. Useful water-soluble dyes include oxonol dyes, hemioxonol dyes, styryl dyes, merocyanine dyes, cyanine dyes and azo dyes. Within these dyes, oxonol dyes, hemioxonol dyes and merocyanine dyes.

In order to improve sensitivity, increase contrast and accelerate development, the photographic emulsion layers of the photographic light-sensitive material of the present invention may contain a developing agent such as, e.g., a polyalkylene oxide or an ether, ester, amine or similar derivative thereof, a thioether compound, a thiomorpholine, a quaternary ammonium salt compound, a urethane derivative, a urea derivative, an imidazole derivative, a 3-pyrazolidone or an aminophenol, etc. Of these, 3-pyrazolidones (1-phenyl-3-pyrazolidone, 1-phenyl-4-methyl-4-hydroxymethyl-3-pyrazolidone, etc.) are preferred, and the addition amount thereof is usually not more than 5 g/m$^2$, and is preferably 0.01 to 0.2 g/m$^2$ of the photosensitive material.

An inorganic or organic film hardener may be included in the non-photosensitive hydrophilic colloid and photographic emulsion of the present invention. For example, active vinyl compounds (1,3,5-triacryloylhexahydro-s-triazine, bis-(vinylsulfonyl)methyl ether, N,N-methylene bis-($\beta$-(vinylsulfonyl)propionamide), etc.), active halogen compounds (2,4-dichloro-6-hydroxy-s-triazine, etc.), mucohalogen acids (mucochloric acid, etc.), N-carbamoylpyridinium salts ((1-morpholino)-carbonyl-3-pyridinium)methanesulfonate, etc.) and haloamidinium salts (1-(1-chloro-1-pyridinomethylene)-pyrrolidinium-2-naphthalenesulfonate, etc.) may be used alone or in combination. Of these, the active vinyl compounds disclosed in JP-A-53-41220, JP-A-53-57257, JP-A-59-162546 and JP-A-60-80846 and the active halogen compounds disclosed in U.S. Pat. No. 3,325,287 are preferred.

A variety of surfactants serving as auxiliary coating agents or for the purpose of the prevention of static, improvement of slip characteristics, emulsification dispersion, prevention of sticking and improvement of photographic characteristics (e.g., by accelerating development, providing better contrast and increasing sensitivity) may be included in the photographic emulsion layer or other hydrophilic colloid layer of the photosensitive material of the present invention.

For example, useful surfactants include saponins (steroid based), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides and silicone polyethylene oxide adducts), glycidol derivatives (e.g., alkenyl succinic acid polyglycerides and alkylphenol polyglycerides), polyvalent alcohol fatty acid esters, sugar alkyl esters and similar nonionic surfactants; alkyl carboxylic acid salts, alkyl sulfonic acid salts, alkylbenzenesulfonic acid salts, alkylnaphthalene sulfonic acid salts, alkyl sulfuric acid esters, alkyl phosphoric acid esters, N-acyl-N-alkyl taurines, sulfosuccinic acid esters, sulfoalkyl polyoxyethylene alkylphenyl ethers, polyoxyethylene alkyl phosphoric acid esters and similar anionic surfactants possessing carboxyl groups, sulfo groups, phospho groups, sulfuric acid ester groups, phosphoric acid ester groups or similar acidic groups; amino acids, aminoalkylsulfonic acids, aminoalkylsulfuric acid esters, aminoalkylphosphoric acid esters, alkylbetaines, aminoxides and similar amphoteric surfactants; and alkylamine salts, aliphatic or aromatic quaternary ammonium salts, pyridinium, imidazolium and similar heterocyclic quaternary ammonium salts, aliphatic or heterocyclic phosphonium or sulfonium salts or similar cationic surfactants.

Also, it is preferably to use a fluorine-containing surfactant as disclosed in JP-A-60-80849, etc. to provide anti-static properties.

Matting agents such as silica, magnesium oxide or polymethylmethacrylate, etc. may be included in the photographic emulsion layers or other hydrophilic colloid layers of the photographic light-sensitive material of the present invention in order to prevent sticking.

A dispersion of a synthetic polymer that is insoluble or difficult to dissolve in water may be included in the photosensitive material of the present invention in order to impart dimensional stability. For example, polymers having repeating units derived from monomer components including alkyl (meth)acrylate, alkoxyacryl (meth)acrylate or glycidyl (meth)acrylate, etc. alone or in combination, or combinations of these substances with acrylic acid or methacrylic acid, etc. can be used.

It is advantageous to use gelatin as a photographic emulsion condensing agent or protective colloid, but it is also possible to use other hydrophilic colloids for this purpose. For example, gelatin derivatives, graft polymers of gelatin and other high molecular weight substances, albumin, casein or similar proteins; cellulose derivatives such as hydroxyethyl cellulose, carboxymethyl cellulose and cellulose sulfuric acid esters, etc., sodium alginate, starch derivatives and similar sugar derivatives, polyvinyl alcohol, polyvinyl alcohol partial acetals, poly-N-vinylpyrrolidone, polyacrylic acid, polymethacrylic acid, polyacrylamide, polyvinylimidazole, polyvinylpyrazole and a large number of similar synthetic hydrophilic high molecular weight substances, as homopolymers or as copolymers, may be used in the photosensitive material of the present invention.

Acid-treated gelatin as well as lime-treated gelatin, or gelatin hydrolysis or enzymolysis products thereof may be used.

A polymer latex such as an alkyl acrylate may be included in the silver halide emulsion for use in the present invention.

Cellulose triacetate, cellulose diacetate, nitrocellulose, polystyrene, polyethylene terephthalate paper, baryta coated paper or polyolefin coated paper, etc. may be used as the support of the photosensitive material of the present invention.

There are no particular restrictions regarding the developing agent of the developing solution for use in processing of the present invention, although addition of a dihydroxybenzene compound thereto is desirable since it facilitates attainment of good dot-image quality. A combination of dihydroxybenzenes and 1-phenyl-3-pyrazolidones, or a combination of dihydroxybenzene and p-aminophenols may be advantageously used.

Examples of dihydroxybenzene developing agents for use in the present invention include hydroquinone, chlorohydroquinone, bromohydroquinone, isopropyl hydroquinone, methyl hydroquinone, 2,3-dichlorohydroquinone, 2,5-dichlorohydroquinone, 2,3-dibromohydroquinone and 2,5-dimethylhydroquinone, etc. but hydroquinone is preferred.

Examples of developing agents in the form of a 1-phenyl-3-pyrazolidone or derivative thereof for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxy-methyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone, etc.

Examples of a p-aminophenol-based developing agent for use in the present invention include N-methyl-p-aminophenol, p-aminophenol, N-(β-hydroxyethyl)-p-aminophenol, N-(4-hydroxyphenyl)glycine and 2-methyl-p-aminophenol-p-benzylaminophenol, etc. and of these, N-methyl-p-aminophenol is preferred.

Normally, the developing agent is preferably used in a concentration of from 0.05 to 0.8 mol/l of the developing solution. If use is made of a combination of dihydroxybenzenes and 1-phenyl-3-pyrazolidones or p-aminophenols, it is preferable to use from 0.5 to 0.5 mol/l of the former and not more than 0.06 mol/l of the latter.

Compounds having silver halide-adsorption accelerating groups (hereafter merely referred to as "accelerating group") which are added in the developing solution of the present invention are generally known as development inhibitors, stabilizers and sensitization dyes, etc., as described in, e.g., *The Theory of Photographic Process*, 3rd Edition, by C. E. K. Mees and T.H. James, published in 1966 by the Macmillan Company, pages 344 to 346, *Research Disclosure* 17643 (RD-17643) and *Research Disclosure* 18716 (RD-18716), etc. Thioamido groups, mercapto groups and 5-member to 6-member nitrogen-containing heterocyclic groups are examples of preferred accelerating groups.

Thioamido groups as the accelerating groups are bivalent groups represented by the formula $$-\overset{\overset{\displaystyle S}{\|}}{C}\text{-amino-},$$

and they may be part of a ring structure or may be an acyclic group. Useful thioamido groups can be selected from among those disclosed in, e.g., U.S. Pat. Nos. 4,030,925, 4,031,127, 4,080,207, 4,245,037, 4,255,511, 4,266,013 and 4,276,364 and Volume 151, No. 15162 (November 1976) and Volume 176, No. 17626 (December 1978) of the Journal "*Research Disclosure*".

Specific examples of the acyclic thioamido groups include thioureido groups, thiourethane groups and dithiocarbamic acid ester groups, etc. and specific examples of the cyclic thioamido groups include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione, etc. and these groups may also be substituted.

Aliphatic mercapto groups, aromatic mercapto groups and heterocyclic mercapto groups (wherein those having a nitrogen atom adjacent to the carbon atom bonded by —-SH groups are equivalent to cyclic thioamido groups to which they stand in a tautomeric relationship, specific examples thereof being the same as cited above) are examples of the mercapto groups for use as accelerating groups of the present invention.

5-member and 6-member nitrogen-containing heterocyclic groups as accelerating groups are exemplified with 5-member and 6-member nitrogen-containing hetero rings constituted by combinations of nitrogen, oxygen, sulfur and carbon. Preferred examples thereof include benzotriazole, triazole, tetrazole, imidazole, benzimidazole, imidazole, benzothiazole, thiazole, benzooxazole, oxazole, thiadiazole, oxadiazole and triazine, etc.

The accelerating groups may be further substituted.

The groups noted below are examples of the substitution groups and these groups may be further substituted.

The substituent groups include, for example, alkyl groups, aralkyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups, carboxyl groups, acyloxy groups, acyl groups, alkyl or aryloxycarbonyl groups, alkenyl groups, alkynyl groups and nitro groups, etc.

The above substituent groups may bond together to form rings.

Particularly preferred silver halide-adsorption accelerating compounds of the present invention are compounds which contain hydrophilic groups, including $-SO_3M$, $-SO_2NHR^1$, $-NHCONHR^1$, $-NHSO_2R^1$, $-CO_2NHR^1$, $-NHCOR^1$, $-PO_3M$, $PO(OR^1)_2$, $PO(NHR^1)_2$, —COOM and OH, etc.

$R^1$ represents hydrogen or an alkyl group having 1 to 5 carbon atoms, and M represents hydrogen, an alkali metal, quaternary ammonium or quaternary sulfonium.

Preferred adsorption accelerating groups are cyclic thioamido groups (i.e., mercapto-substituted nitrogen-containing hetero rings, e.g., 2-mercaptothiadiazole groups, 3-mercapto-1,2,4-triazole groups, 5-mercaptotetrazole groups, 2-mercaptobenzoxazole groups, 2-mercaptobenzthiazole groups, 2-mercaptobenzimidazole groups and mercaptotetraazaindene groups, etc.).

The compounds having adsorption accelerating groups may also contain suitable substituents.

Specific examples of preferred compounds of the present invention containing adsorption accelerating groups are given below.

V-1

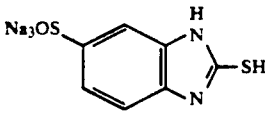

V-2

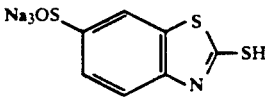

V-3

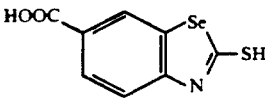

-continued

V-4

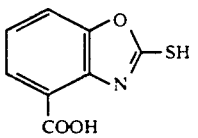

V-5

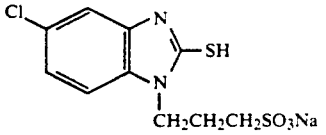

V-6

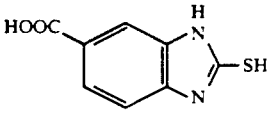

V-7

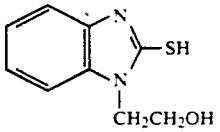

V-8

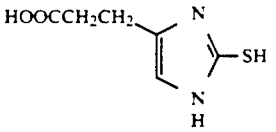

V-9

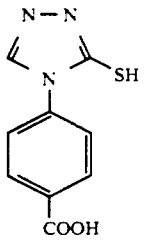

V-10

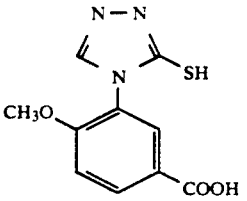

V-11

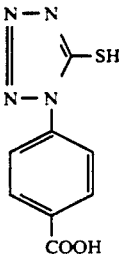

-continued
V-12
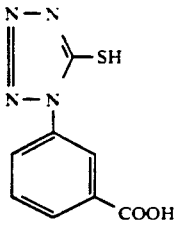
V-13
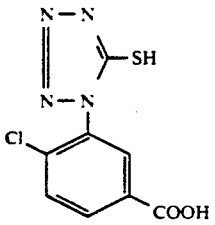
V-14
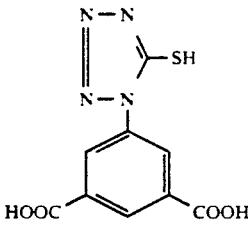
V-15
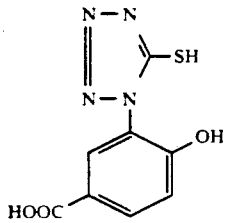
V-16
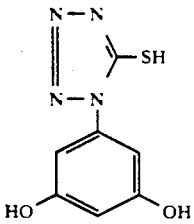
V-17
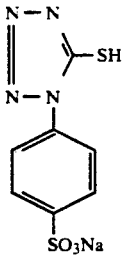
V-18
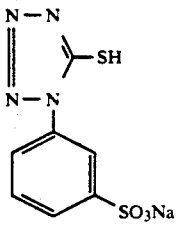
-continued
V-19
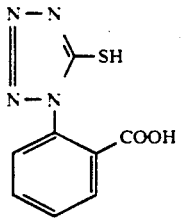
V-20
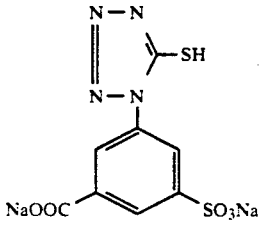
V-21
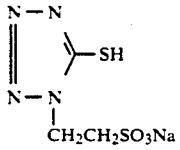
V-22
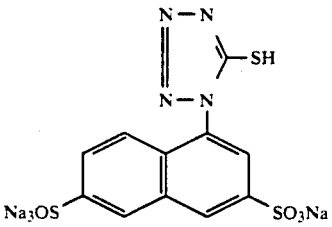
V-23
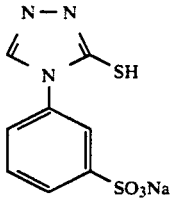
V-24
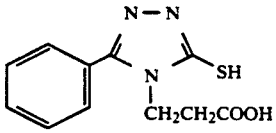
V-25
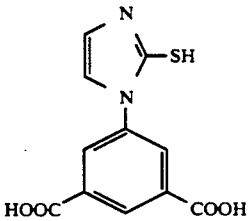

-continued

V-26

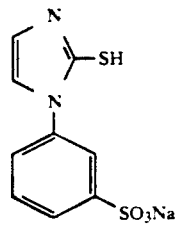

V-27

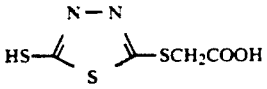

V-28

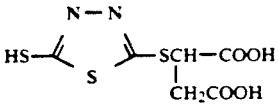

V-29

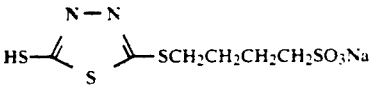

V-30

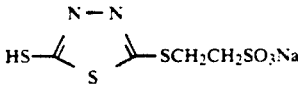

V-31

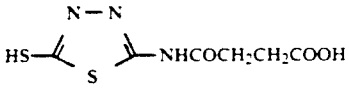

V-32

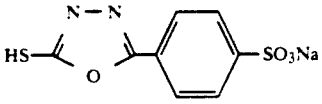

V-33

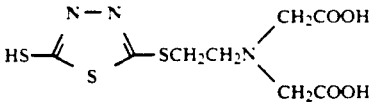

V-34

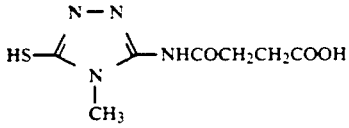

V-35

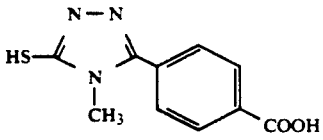

V-36

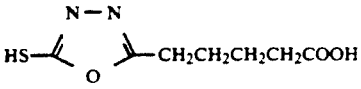

V-37

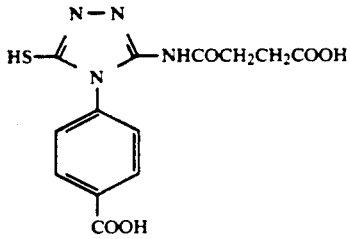

-continued

V-38

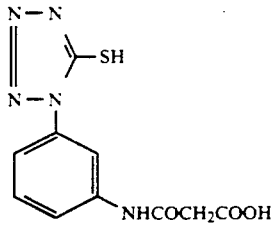

The silver halide adsorption accelerating compound of the present invention is preferably added in an amount of from 10mg to 1 g, more preferably from 40 mg to 500 mg, per liter of the developing solution.

Examples of sulfurous acid salt preservatives for use in the present invention include sodium sulfite, potassium sulfite, lithium sulfite, ammonium sulfite, sodium bisulfite, potassium metabisulfite and sodium formaldehyde bisulfite, etc. The concentration of sulfurous acid ions in the developing solution for use in processing the photosensitive material of the present invention is 0.15 mol/l or more and preferably not more than 2.5 mol/l, and more preferably from 0.4 to 1.2 mol/l.

Alkali agents used for adjusting the pH of the developing solution (generally to 9.5 or higher and preferably from 10.0 to 12.0) for use in processing the photosensitive material of the present invention include pH regulators and buffers such as sodium hydroxide, potassium hydroxide, sodium carbonate, potassium carbonate, sodium tertiary phosphate, potassium tertiary phosphate, sodium silicate and potassium silicate.

Other additives for use in the developing solution for use in processing the photosensitive material of the present invention include compounds of boric acid, borax, etc. sodium bromide, potassium bromide, potassium iodide or similar development inhibitors; ethylene glycol, diethylene glycol, triethylene glycol, dimethyl formamide, methylcellosolve, hexylene glycol, ethanol, methanol or similar organic solvents; and indazole compounds such as 5-nitroindazole, benzotriazole compounds such as 5-methylbenzotriazole or similar antifogging agents, in addition to which toning agents, surfactants, defoaming agents, water softeners, film hardeners and development acceleration agents, etc. may be included as required. In particular, the amino compounds disclosed in JP-A-56-106244 and the imidazole compounds disclosed in JP-B-48-35493 are used advantageously since these compounds accelerate development and increase sensitivity.

Boric acid as described in JP-A-62-186259, sugars (e.g., saccharose) as described in JP-A-60-93433, oximes (e.g., acetomixe), phenols (e.g., 5-sulfosalicylic acid) or tertiary phosphates (e.g., a sodium salt or potassium salt), etc. may be used as buffers for the developing solution for use in processing the photosensitive material of the present invention, but boric acid is preferably used.

The fixing solution for use in processing the photosensitive material of the present invention is an aqueous solution which may contain a film hardening agent (e.g., a water-soluble aluminum compound), acetic acid and dibasic acids (e.g. tartaric acid, citric acid or salts of these acids) as well as a fixing agent. The pH of the fixing solution is preferably at least 3.8, preferably in the range of from 4.0 to 5.5.

Useful fixing agents include sodium thiosulfate and ammonium thiosulfate, etc., ammonium thiosulfate being particularly referred with respect to the fixing rate. The concentration of the fixing agent in the fixing solution used may be suitably varied, but is generally about 0.1 to about 5 mol/l.

Water-soluble aluminum salts for use as film hardeners in the fixing solution are film hardeners for acidic film hardening and fixing solutions and include, e.g., aluminium chloride, aluminium sulfate and potassium alum, etc.

Tartaric acid or derivatives thereof, or citric acid or derivatives thereof can be used alone or in combination thereof as the above noted dibasic acids. Preparations containing 0.005 moles or more of these compounds per 1 liter of fixing solution are effective and a content of 0.01 to 0.03 mol/l is particularly effective.

Useful tartaric acid derivatives include tartaric acid, potassium tartarate, sodium tartarate. potassium sodium tartarate, ammonium tartarate and ammonium potassium tartarate, etc.

Examples of citric acid and its derivatives which are useful in the fixing solution for processing the present invention include citric acid, sodium citrate and potassium citrate, etc.

The fixing solution may further contain a preservative (e.g., a sulfite or bisulfite), a pH buffer (e.g., acetic acid or boric acid), a pH regulator (e.g., ammonia or sulfuric acid), an image preservation improvement agent (e.g., potassium iodide) and a chelating agent. Since developing solutions have a high pH, the amount of pH buffer used in the fixing solution is 10 to 40 g/l and preferably 18 to 25 g/l to compensate for carry over.

The fixing and developing temperature and time are each preferably 10 seconds to 1 minute at about 20° C. to 50° C.

The water for water-washing may contain anti-mold agents (e.g., the compounds described in *Chemistry of Bacteria and Fungus Prevention* (Bokin Bobai no Kagaku) by Horiguchi and JP-A-62-115154) and water-washing acceleration agents (sulfites, etc.) and chelating agents, etc.

According to the above water-washing method, developed and fixed photographic material is washed with water and then dried. Water-washing is done in order to effect substantially complete removal of silver salts that have been dissolved as a result of fixing and is preferably conducted for 10 seconds to 3 minutes at about 20° C. to 50° C. Drying is effected at about 40° C to 100° C., and the drying time is suitably varied in accordance with ambient conditions, but is normally about 5 seconds to 3 minutes 30.seconds.

Details of roller transport type automatic development units are disclosed in U.S. Pat. Nos. 3,025,779 and 3,545,971, etc., and this is the type of roller transport type processor referred to herein. A roller transport type processor comprises four stages including development, fixing, water-washing and drying, and it is most preferred to follow this procedure in the method of the present invention, although other stages (e.g., a stopping stage) are not precluded. Economizing of the processing water can be effected by using a 2 to 3 step countercurrent water-washing system for the water-washing stage.

The developing solution for use in the present invention is preferably stored in a packing material having a low permeability to oxygen, as described in JP-A-61-73147 and the replenishment system described in JP-A-62-91939 is preferably used together with the above noted developing solution.

A detailed description of the present invention is given below with reference to the following nonlimiting examples.

EXAMPLE 1

Emulsions A to E were prepared in the following manner.

Emulsion A

An aqueous solution of silver nitrate and an aqueous solution containing sodium bromide and sodium chloride and further containing $3\times10^{-7}$ mol of $K_3IrCl_6$ and $3\times10^{-7}$ mol of $(NH_4)_3RhCl_6$ per mol of silver were added simultaneously over a 30 minutes period to a gelatin aqueous solution kept at 58° C. and at a constant potential of 150 mV during the addition period, to obtain a monodisperse silver chlorobromide emulsion having an average grain diameter of 0.28 μm. Conversion was effected by adding to this emulsion 0.2 mol % of a 1 wt % potassium iodide aqueous solution per 1 mol of silver. The emulsion was then desalted by a flocculation process. The resulting emulsion was then chemically ripened by the addition of hypo and chloroauric acid at a temperature 60° C., and then 30 ml of a 1 wt % solution of 4-hydroxy-6-methyl-1,3,3a,7-tetrazaindene per 1 mol of silver was added as a stabilizer. The emulsion thus prepared had a silver halide composition of $AgCl_{97.8}Br_2I_{0.2}$.

Emulsion B

A monodisperse silver chloroiodobromide emulsion having an average grain diameter of 0.29 μm was prepared by exactly the same procedure as used for Emulsion A in the presence of 1,3-dimethyl-2-imidazolinethione (silver halide solvent) in a gelatin aqueous solution held at a temperature of 50° C. ($AgCl_{94.8}Br_5I_{0.2}$)

Emulsion C

An aqueous solution of silver nitrate and an aqueous solution of sodium chloride containing $3\times10^{-7}$ mol of $K_3IrCl_6$ and $3\times10^{-7}$ mol of $(NH_4)_3RhCl_6$ per 1 mol of silver were added simultaneously over a 30 minutes period to a gelatin aqueous solution that was kept at 58° C. and at a constant potential of 150 mV during the addition period. After this, conversion was effected by adding 2 mol % of a 1 wt % potassium bromide aqueous solution and 0.2 mol % of a 1 wt % potassium iodide aqueous solution per 1 mol of silver. The resulting emulsion was chemically ripened by the addition of hypo and chloroauric acid at 60° C., and then the stabilizer of Emulsion A was added in the same manner as for Emulsion A. ($AgCl_{99.8}I0.2$)

Emulsion D

An aqueous solution of silver nitrate and aqueous solutions of sodium chloride containing $3\times10^{-7}$ mol of $K_3IrCl_6$ and $3\times10^{-7}$ mol of $(NH_4)_3RhCl_6$ and sodium bromide equivalent to 20 mol % per 1 mol of silver were added simultaneously over a 30 minute period to a gelatin aqueous solution that was kept at 50° C. and at a constant potential of 70 mV during this period, to obtain a monodisperse silver chlorobromide emulsion having an average grain diameter of 0.28 μm. Conversion was effected by adding to this emulsion 0.2 mol % of a 1 wt % potassium iodide aqueous solution per 1 mol of silver. Desalting was then effected by a flocculation process. The resulting emulsion was chemically ripened by the addition of hypo and chloroauric acid at 60° C., ripening and then the stabilizer of Emulsion A was added in the same manner as for Emulsion A. ($AgCl_{79.8}Br_{20}I_{0.2}$)

Emulsion E A silver chloroiodobromide emulsion having a silver bromide content of 30 mol % was prepared by the same procedure as for Emulsion D.

The following table summarizes the properties of Emulsion A to E.

TABLE 1

| Emulsion | Halogen Composition | Dispersion Coefficient (%) | Grain Size (μm) | Crystal Habit |
|---|---|---|---|---|
| A | $AgCl_{97.8}Br_2I_{0.2}$ | 8 | 0.28 | Cubic |
| B | $AgCl_{94.8}Br_5I_{0.2}$ | 10 | 0.29 | " |
| C | $AgCl_{99.8}I_{0.2}$ | 9 | 0.30 | " |
| D* | $AgCl_{79.8}Br_{20}I_{0.2}$ | 10 | 0.28 | " |
| E* | $AgCl_{69.9}Br_{30}I_{0.1}$ | 12 | 0.28 | " |

*Comparison 1 kg lots of these emulsions were sensitized to the infrared region by the addition of 60 ml of a 0.05 wt % solution of the infrared sensitizing dye represented by I-6. 70 ml of a 0.5 wt % methanol solution of disodium 4,4'-bis-(4,6-dinaphthoxy-pyrimidin-2-ylamino) stilbene disulfonate and 90 ml of a 0.5 wt % methanol solution of a 2,5-dimethyl-3-allyl-benzothiazole iodine salt were then added to each emulsion. Further, 100 mg/m² of hydroquinone, 25 wt % based on gelatin binder of polyethylacrylate latex as a plasticizer, 80mg/m² of 2-bis(vinyl sulfonyl acetamido) ethane as a film hardener and 40 mg/m² of 2,4-dichloro-6-hydroxy-s-triazine were added to each emulsion and the materials were coated on polyester supports in an amount of 3.7 g/m² of silver. The gelatin coated amount was 2.5 g/m².

An upper protective layer was provided to each material comprising 0.6 g/m² of gelatin and, as matting agents, 60 g/m² of polymethylmethacrylate having a particle diameter of 3 to 4 μm, 70 mg/m² of colloidal silica having a particle diameter of 10 to 20 mμ and 100 mg/m² of silicone oil, to which 20 mg/m² of sodium dodecylbenzenesulfonate and 5 mg/m² of a fluorine based surfactant with the structural formula (1) noted below had been added as coating assistants.

A lower protective layer was provided to each material comprising 0.7 g/m² of gelatin, 225 mg/m² of polyethylacrylate latex, 20 mg/m² of the dye with the structural formula (2) shown below, 10 mg/m² of the dye with the structural formula (3) shown below and, as an auxiliary coating agent, sodium dodecylbenzenesulfonate. The upper and lower protective layers simultaneously coated to provide Sample Materials 1 to 5.

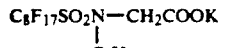

(1)

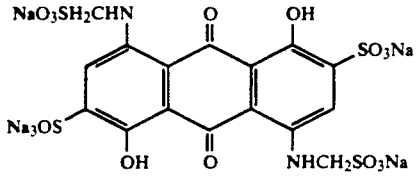

(2)

-continued

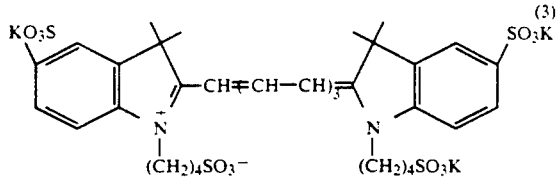

(3)

The bases used in this example each had a backing layer and a backing protection layer with the following composition.

| | |
|---|---|
| Backing layer: | |
| Gelatin | 3.0 g/m² |
| Sodium dodecylbenzenesulfonate | 80 mg/m² |
| 1,3-divinylsulfonyl-2-propanol | 60 mg/m² |
| Potassium polyvinyl-benzenesulfonate | 30 g/m² |
| Dye a | 80 mg/m² |

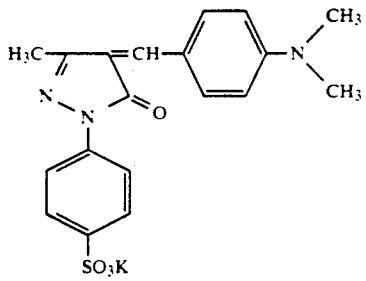

| | |
|---|---|
| Dye b | 30 mg/m² |

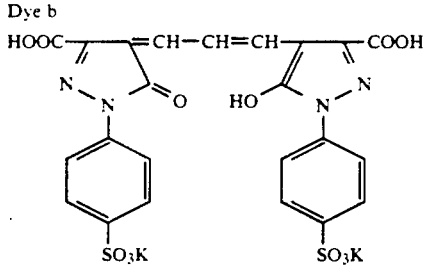

| | |
|---|---|
| Dye c | 100 mg/m² |

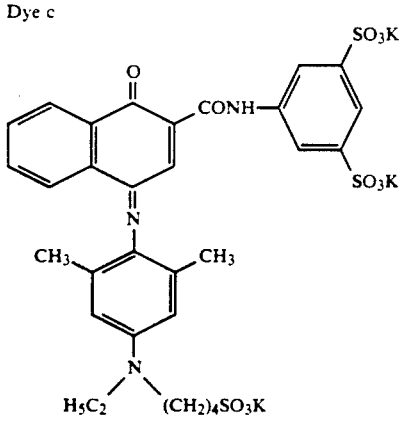

| | |
|---|---|
| Backing protection layer: | |
| Gelatin | 0.75 g/m² |
| polymethylmethacrylate (particle size 4.7 μm) | 30 mg/m² |
| Sodium dodecylbenzenesulfonate | 20 mg/m² |
| Fluorine-based surfactant (abovenoted compound (1)) | 2 mg/m² |
| Silicone oil | 100 mg/m² |

Evaluation of photographic properties:

The resulting sample materials were exposed, using an interference filter with a peak at 780 nm and a continuous wedge, using a xenon flash light with a light emission period of $10^{-6}$ seconds. The materials thus exposed were developed at 38° C. for 20 seconds in FG-360F automatic developer manufactured by Fuji Photo Film Co., Ltd. using a developing solution with the composition noted below, fixed (LF-308), washed with water, dried and subjected to sensitometry. (Photographic property 1)

To assess running qualities, quarter size (25.4 cm×30.5 cm) samples of the various materials were exposed to obtain an exposed area of 50% based on the entire surface. 100 samples were then processed in succession without replenishment. Afterwards, the sample materials were exposed and processed in the well used processing solutions in the same manner as described above. (Photographic property 2)

Relative sensitivity was measured taking the sensitivity to be the reciprocal of the amount of exposure required to provide a density of 3.0 as noted in Table 2. (Sample Material No. 1 was taken to be 100.) $\gamma$ is a parameter of the characteristic curve and is the slope of the straight line joining the 0.3 and 3.0 density points. The greater the value of $\gamma$, the greater the contrast. As is clear from Table 2, there is comparatively little reduction in the sensitivity of the material of the present invention when processed in well-used solutions. (Photographic property 2)

| Development solution: | |
|---|---|
| Hydroquinone | 45.0 g |
| N-methyl-p-aminophenol ½ sulfuric acid salt | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Ethylenediaminetetraacetic acid disodium salt | 1.0 g |
| 2-Mercaptobenzimidazole 5 sulfonic acid | 0.3 g |
| Potassium bromide | 6.0 g |
| 5-Methylbenzotriazole | 0.6 g |
| n-Butyldiethanolamine | 15.0 g |
| Water added | 1 liter |
| pH | 11.6 |

TABLE 2

| Sample material No. | Emulsion Used | Photographic property 1 Relative sensitivity | Photographic property 1 $\gamma$ | Photographic Property 2 Relative sensitivity | Photographic Property 2 $\gamma$ |
|---|---|---|---|---|---|
| 1 | A | 100 | 7.6 | 95 | 5.8 |

TABLE 2-continued

| Sample material No. | Emulsion Used | Photographic property 1 Relative sensitivity | Photographic property 1 $\gamma$ | Photographic Property 2 Relative sensitivity | Photographic Property 2 $\gamma$ |
|---|---|---|---|---|---|
| 2 | B | 110 | 7.8 | 100 | 6.9 |
| 3 | C | 98 | 7.9 | 92 | 7.0 |
| 4* | D | 100 | 7.6 | 81 | 6.0 |
| 5* | E | 110 | 7.0 | 87 | 5.4 |

*Comparison

EXAMPLE 2

The Sample Materials 1 and 3 of Example 1 were processed in a developing solution containing a compound of the present invention possessing silver halide-adsorption accelerating groups as indicated in Table 3. Silver fouling and physical development unevenness as well as relative sensitivity were evaluated.

The evaluation procedure consisted of first processing 200 sheets of quarter size film having a 50% exposed area in an FG-360F automatic developer manufactured by Fuji Photo Film Co., Ltd., with replenishment at a level necessary to maintain the solution level during the processing. Then, whole-surface exposed samples and unexposed samples of Sample Materials 1 and 3 (quarter size) of Example 1 were processed. Relative sensitivity was evaluated in the same manner as in Example 1, and silver fouling and physical development unevenness were evaluated as described below. The tested developing solutions are indicated in Table 3 and the results are given in Table 4. As is clear from Table 4, the developing solutions 2, 3, 4 and 6 containing the compound of the present invention provide superior results.

Silver fouling was evaluated in 5 stages such that a score of "5" was assigned to a state wherein no silver fouling at all occurred on a film and the score "1" to a state wherein silver fouling occurred over the entire film surface. An assignment of "4" indicates that silver fouling had occurred on a very restricted portion of film and is at a level which is permissible for practical use. An assignment of "3" or less indicates material that is not useful for practical purposes.

Physical development unevenness was evaluated in 5 stages such that a score of "5" was assigned to a state wherein physical development unevenness did not at all occurred on the subject film and the score "1" to a state wherein physical development unevenness occurred over the entire film surface. An assignment of "4" indicates that physical development unevenness had occurred on a very restricted portion of film and is at a level which is permissible for practical use. An assignment of "3" or less indicates that the material is not useful for practical purposes.

TABLE 3

| Composition | Developing solution 1* | 2 | 3 | 4 | 5* | 6 |
|---|---|---|---|---|---|---|
| Ethylenediaminetetraacetic acid tetrasodium salt | 1.0 g | " | " | " | " | " |
| Sodium hydroxide | 9.0 g | " | " | " | " | " |
| 5-Sulfosalicylic acid | 70.0 g | " | " | " | " | " |
| Potassium sulfite | 110.0 g | " | " | " | " | " |
| 5-Methylbenzotriazole | 0.35 g | " | " | " | " | " |
| Potassium bromide | 5.0 g | " | " | " | " | " |
| N-Methyl-p-aminophenol ½ $H_2SO_4$ | 1.0 g | " | " | " | " | " |
| Hydroquinone | 44.0 g | " | " | " | " | " |
| n-Butylethanolamine | 16.0 g | " | " | " | " | " |
| Boric acid | 5.0 g | " | " | " | " | " |

TABLE 3-continued

| Composition | Developing solution 1* | 2 | 3 | 4 | 5* | 6 |
|---|---|---|---|---|---|---|
| (V)-1 | — | 0.116 g (0.5 mM) | — | — | — | — |
| (V)-12 | — | — | 0.111 g (0.5 mM) | — | — | — |
| (V)-18 | — | — | — | 0.129 g (0.5 mM) | — | 0.129 g (0.5 mM) |
| Water added | 1 l | " | " | " | " | " |
| pH | 11.7 | " | " | " | 10.7 | " |

*Comparison

TABLE 4

| Development solution No. | Sample Material No. 1 Relative sensitivity | Silver fouling | Development unevenness | Sample Material No. 3 Relative sensitivity | Silver fouling | Development unevenness |
|---|---|---|---|---|---|---|
| 1* | 100 | 1 | 1 | 100 | 1 | 1 |
| 2 | 100 | 4 | 4 | 98 | 4 | 4 |
| 3 | 98 | 4 | 5 | 95 | 5 | 5 |
| 4 | 98 | 5 | 5 | 98 | 5 | 5 |
| 5* | 87 | 2 | 4 | 87 | 2 | 4 |
| 6 | 85 | 5 | 5 | 83 | 5 | 5 |

*Comparison

While the invention has been described in detail and with reference to specific embodiments thereof, it will be apparent to one skilled in the art that various changes and modifications can be made therein without departing from the spirit and scope thereof.

What is claimed is:

1. A method of image formation using a silver halide photographic material comprising a support having thereon at least one light-sensitive layer comprising a silver halide emulsion sensitized by an infrared sensitizing dye, wherein the silver halide in said silver halide emulsion contains at least 90 mol % of silver chloride and the silver halide comprises monodisperse grains having a coefficient of variation of not more than 20%, which comprises the steps of imagewise exposing the photographic material and developing said material in a developing solution containing at least 0.15 mol/l of sulfite ions and a mercapto heterocyclic compound having a silver halide-adsorption accelerating group and having a hydrophilic group.

2. A method of image formation as in claim 1, wherein said compound containing a silver halide-adsorption accelerating group is present in the developing solution in an amount of from 10 mg/l to 1 g/l.

3. A method of image formation as in claim 1, wherein the concentration of sulfite ions in the developing solution is in the range of from 0.4 to 1.2 mol/l.

4. A method of image formation as in claim 1, wherein said developing step constitutes continuous processing.

5. A method of image formation as in claim 1, wherein said silver halide contains at least 95 mol % of silver chloride.

6. A method of image formation as in claim 1, wherein said silver halide is selected from the group consisting of silver chlorobromide, silver chloroiodide and silver chloroiodobromide containing 0 to 10 mol % of silver bromide and 0 to 2 mol % of silver iodide.

7. A method of image formation as in claim 1, wherein said monodisperse grains have a coefficient variation of not more than 15%.

8. A method of image formation as in claim 1, wherein the infrared sensitizing dye is present in an amount of from $5\times10^{-7}$ to $5\times10^{-3}$ mol per mol of silver halide.

9. A method of image formation as in claim 1, further comprising a compound which enhances the sensitization effect of the infrared sensitization dye in an amount of from about 0.01 to 5 g per mol of silver halide.

10. A method of image formation as in claim 1, further comprising a polyhydroxybenzene compound in an amount of from $1\times10^{-5}$ to 1 mol per mol of silver halide.

11. A method of image formation as in claim 1, further comprising an antihalation dye or an anti-irradiation dye in an amount of from $1\times10^{-3}$ g/m$^2$ to 1 g/m$^2$.

* * * * *